United States Patent [19]

Harmathy

[11] 3,955,323

[45] May 11, 1976

[54] MEANS FOR RETARDING THE SPREAD OF FIRE FROM A BUILDING SPACE

[75] Inventor: Tibor Z. Harmathy, Ottawa, Canada

[73] Assignee: Canadian Patents and Development Limited, Ottawa, Canada

[22] Filed: June 4, 1975

[21] Appl. No.: 583,519

[52] U.S. Cl. ..... 52/1; 98/42 R; 98/86; 49/1

[51] Int. Cl.[2] ..... F24F 7/06

[58] Field of Search ..... 160/9; 52/302, 303, 52/1; 98/86, 42 R, 43 R, 43 A; 49/1

[56] References Cited

UNITED STATES PATENTS

| | | | |
|---|---|---|---|
| 282,822 | 8/1883 | Willard | 98/86 |
| 609,278 | 8/1898 | Kane | 98/86 |
| 665,890 | 1/1901 | Farrar | 98/86 |
| 3,818,816 | 6/1974 | Petit | 98/86 |

*Primary Examiner*—John E. Murtagh
*Attorney, Agent, or Firm*—Francis W. Lemon

[57] ABSTRACT

Means for retarding the spread of fire from a building space, comprising an upwardly extending duct, the cross-sectional area of which is related by formulae to the cross-sectional area for air intake to the space, and has an access gate at the lower end for connecting the duct with the building space, and preferably a release gate at the upper end for connecting the duct with the outside atmosphere. Preferably the access gate and release gate are thermally actuated by having heat destructible components which are destroyed by flames from a fire in the space. The cross-sectional area of the duct and of the air intake are determined by design to i) drain away flames and smoke, ii) produce a depression in the building space thereby retarding the spread of fire, and iii) draw sufficient air to the building space to ensure relatively low fire temperature and a relatively short fire duration. The same ducts may serve a number of building spaces above one another at different floor levels. Open plan buildings and corridors may have drop curtains which isolate the or each building space in the event of fire, but leave openings for the designed air intake.

7 Claims, 8 Drawing Figures

MEANS FOR RETARDING THE SPREAD OF FIRE FROM A BUILDING SPACE

Figure 1:
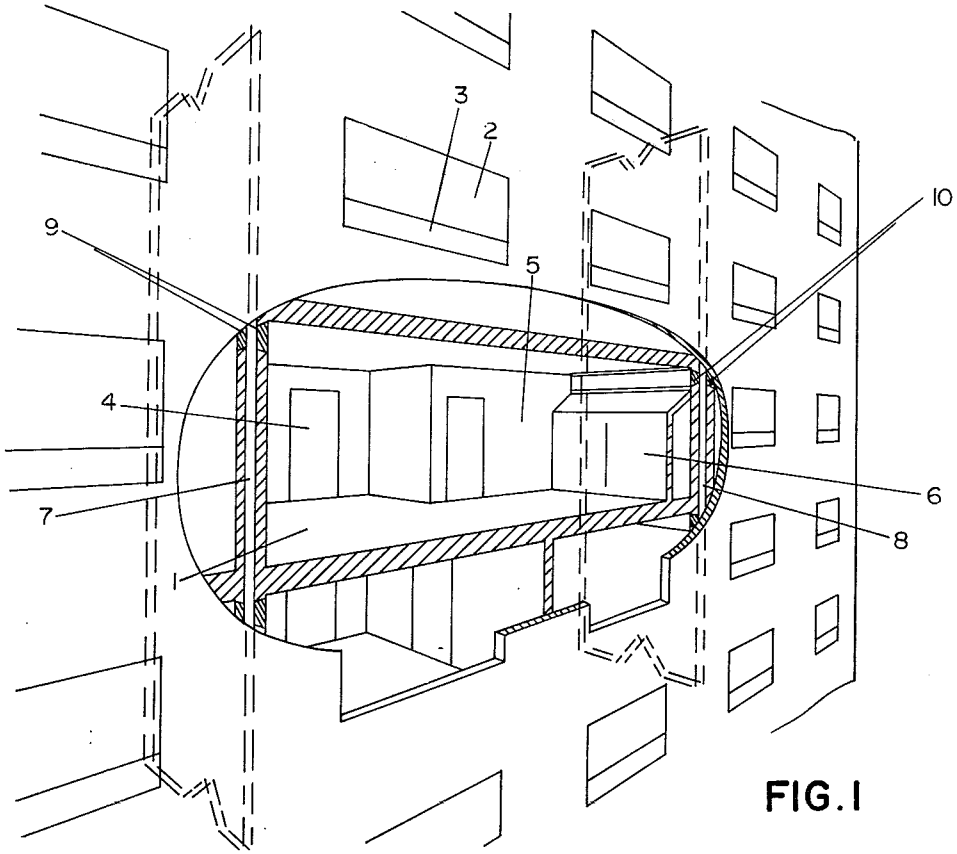

This invention relates to means for retarding the spread of fire from a building space, having air intake thereto.

During the past several decades an unprecedented evolution has been going on in the exterior and interior design of buildings. Most innovations are introduced with the purpose of serving the convenience of the occupants and reducing the costs of construction. Unfortunately, in an attempt to achieve these objectives, some problems of public safety during emergencies are often overlooked. This is especially true with respect to the safety of occupants in the case of a fire. Because of the rapid advances in building technology, many conventional methods of providing fire safety have become ineffective and not adaptable to the changed conditions. It appears now that the time has arrived when further progress can only be made by developing a new system of defence against fire right from basic principles.

It is a main object of the present invention to provide a means for retarding the spread of fire from a building space, which may be described as "fire drainage" system, by which the fire safety in buildings can be substantially improved when compared with known means of fire protection.

According to the present invention there is provided a means for retarding the spread of fire from a building space, having air intake thereto, comprising:

a. upwardly extending duct means, having poor heat transmitting walls, for connecting the building space to the outside atmosphere, b. closure means, tightly closing and thermally insulating the building space from the duct means, c. means urging the closure means to open and thereby establishing connection between the building space and the duct means, d. securing means, releasably scuring the closure means in the closed position, and wherein e. for most effective operation, the following two conditions are satisfied, relying on the state of the art:

$$\frac{A_c}{A_D} \leq \frac{1}{1.163\psi\delta}\left\{\frac{1}{2\alpha}\ \frac{\rho_d}{\rho_e}\left[g(\rho_a-\rho_d)\frac{H_1-z}{p_e-p}-\frac{p_a-p}{p_e-p}\right]\right\}^{1/2}$$

$$\text{and}\quad \frac{A_c\delta[2\rho_e(p_e-p)]^{1/2}}{C\phi G} > 1$$

where $A_C$ ($m^2$) is the cross-sectional area for the air intake to the building space, $A_D$ ($m^2$) is the cross-sectional area of the duct means, $\psi$ (dimensionless) is a factor characteristic of the air-tightness of the duct means, $\delta$ (dimensionless) is an orifice factor characteristic of the sizes of the area for air intake, $\alpha$ (dimensionless) is a factor describing, in terms of velocity head, the pressure losses at the entry and exit of fire gases to and from the duct means, and the frictional losses within the duct means when in operation, $g$ ($m/s^2$) is the acceleration due to gravity, $\rho d$ ($kg/m^3$) is the average density of the fire gases in the duct means when in operation, $\rho e$ ($kg/m^3$) is the density of air in the space from which it enters the building space when on fire, $\rho a$ ($kg/m^3$) is the density of the outside atmosphere, $H_1$ (m) is the height of the duct means, $z$ (m) is the elevation of the building space, $P_e$ ($kg/m\ s^2$) is the pressure of the space from which the bulk of air enters the building space, $P_a$ ($kg/m\ s^2$) is the pressure of the outside atmosphere, $p$ ($kg/m\ s^2$) is the desired pressure in the building space which, for correct operation in fire, is equal to or lower than the pressure in any adjoining space to be protected from the penetration of flames and fire gases, C ($kg/m^2\ s$) is a constant characteristic of the combustible materials in the building space, $\phi$ ($m^2/kg$) is the specific surface of the combustible materials, and G (kg) is the total mass of the combustible materials in the building space, whereby f. in the event of fire in the building space the securing means are actuated to release the closure means, so that the means urging the closure means moves the closure means to connect the building space with the duct means acting in conjunction with the air intake to i) drain away flames and smoke from the fire, ii) produce a depression in the building space thereby retarding the spread of fire, and iii) draw sufficient air to the building space to ensure relatively low fire temperature and a relatively short fire duration.

Figure 2:
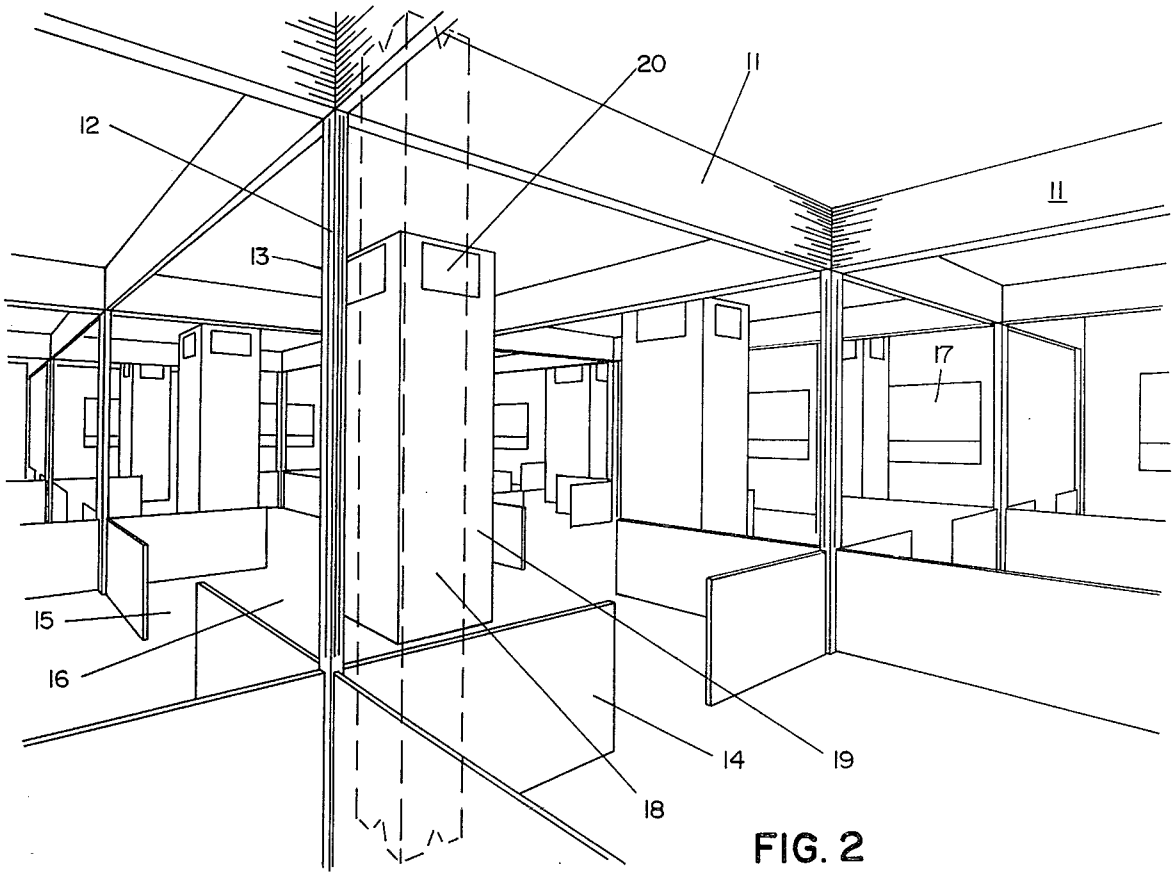
Figure 3:
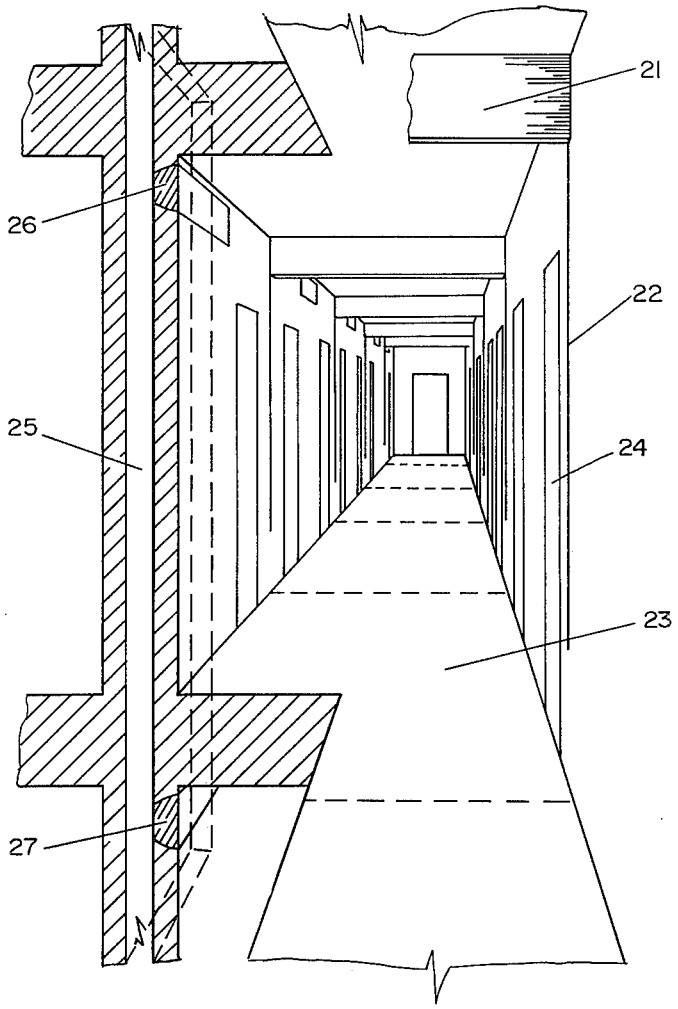
Figure 4B:
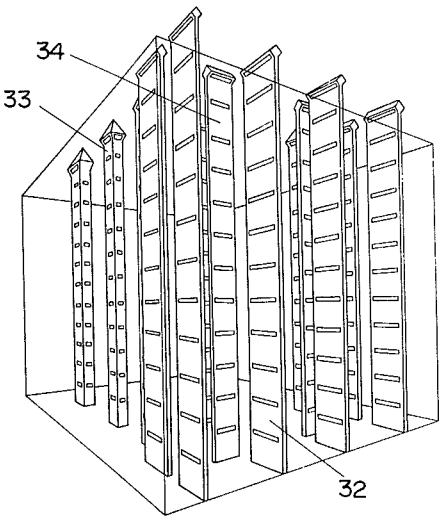
Figure 4A:
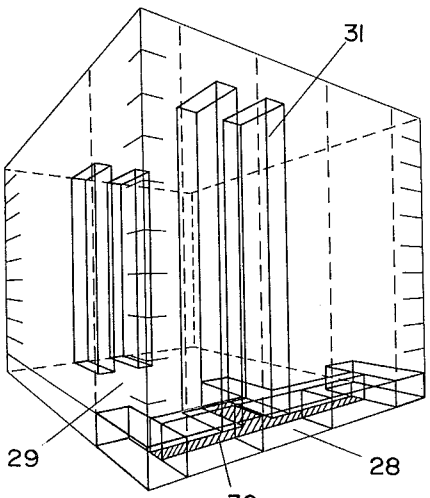
Figure 5:
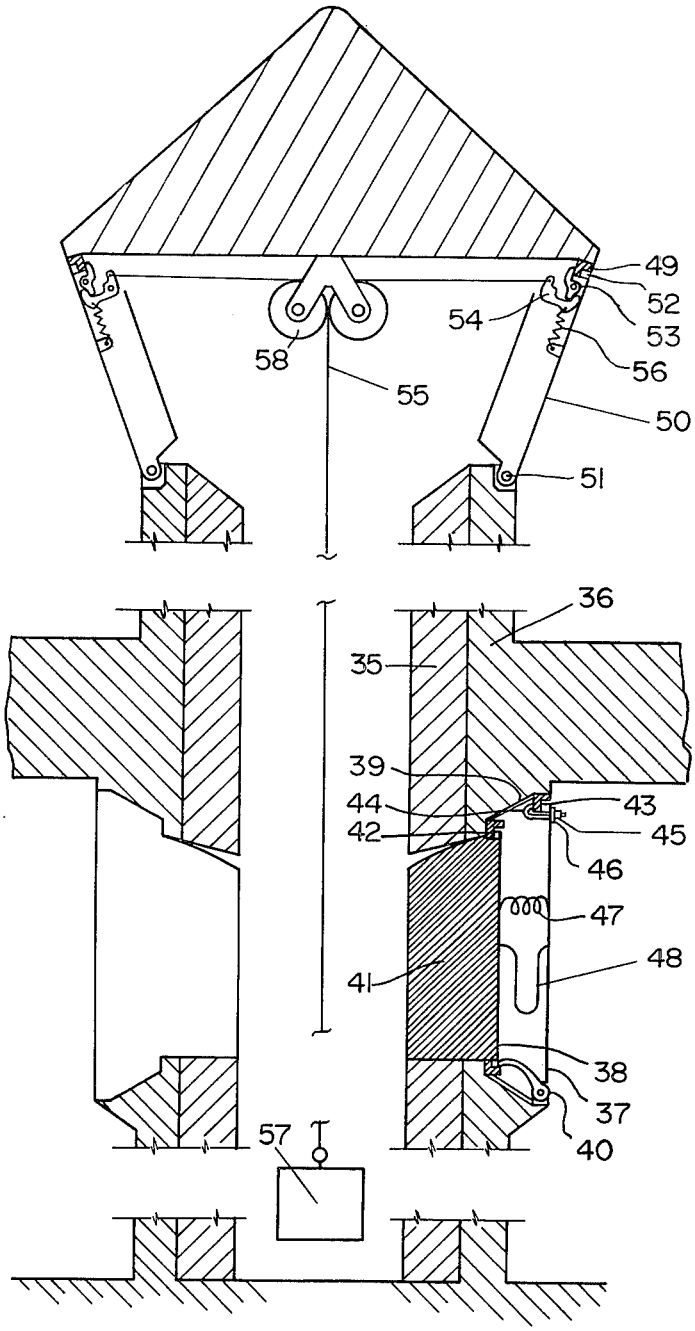
Figure 7:
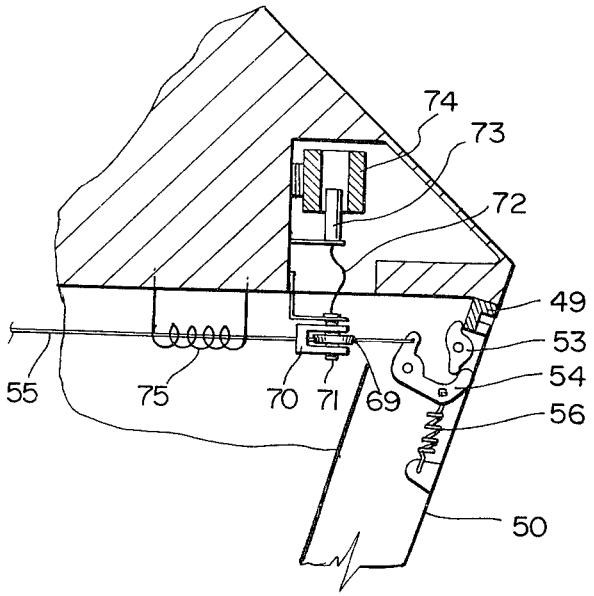
Figure 6:
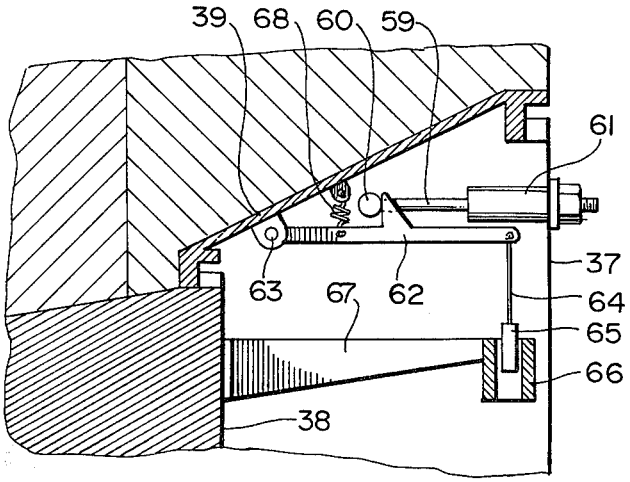

In the accompanying drawings which illustrate, by way of example, embodiments of the present invention:

FIG. 1 is a partly sectioned, perspective view of a portion of a compartmented building having the rooms therein equipped with means for retarding the spread of fire, which may be described as a fire drainage system, FIG. 2 is a perspective view of the interior of an uncompartmented space of a building, with the space equipped with means for retarding the spread of fire, which may be described as a fire drainage system, FIG. 3 is a partly sectioned, perspective view of a corridor of a building, with the corridor equipped with means for retarding the spread of fire, which may be described as a fire drainage system, FIGS. 4*a* and 4*b* are perspective views showing the constituents spaces of an eleven-storey office building and the fire drainage system for the building, respectively, FIG. 5 shows a sectional side view of portions of a fire drainage duct, and FIGS. 6 and 7 show different components for the fire drainage duct shown in FIG. 5

The operation of the means for retarding the spread of fire according to the present invention is based on a coordinated withdrawal of flames and smoke from, and admission of air to the building space containing the fire. This operation is accomplished by exploiting the thermal energy provided by the fire itself.

Venting has long been an effective tool in controlling fires, primarily from the point of view of improving the visibility for fire fighting and rescue operations. The practical aspects of venting have been outlined in "Guide For Smoke and Heat Venting", 1968, No. 204, National Fire Protection Association, Boston, Mass.

The suggestion of venting building spaces on fire sounds paradoxical at first. Venting is usually accompanied by significant increase of air flow and often also by increase in the rate of burning. Over the years, people have become accustomed to the idea that the principal objective of fire fighting is the early suppression of fire, and any measure that results in increasing rate of heat evolution would seem to work against this objective. The facts, however, do not support this notion. Comprehensive studies reported under the title "A New Look at Compartment Fires, Parts I and II", by T. Z. Harmathy, in Fire Technology, Vol. 8, 1972, pp. 196–217 and 326–351, clearly revealed that the increased rate of inflow of cool air, above a certain threshold value, not only helps to keep the fire temperature down in spite of the increased rate of buring, but also reduces the duration of fire. If the flow rate of air is above this threshold value, the rate of burning is independent of the rate of inflow of air and it is controlled by and roughly proportional to the surface area of the combustible materials; the fire is "fuel-surface-controlled". If, on the other hand, the flow rate of air is below this threshold value, the rate of burning is independent of the surface area of the combustible materials and it is controlled by and roughly proportional to the flow rate of air; the fire is "ventilation-controlled". Hundreds of experimental data indicated that fuel-surface-controlled fires are relatively short and the average fire temperatures are relatively low. Ventilation-controlled fires have been found to last longer and the average fire temperatures are often very much higher. It is a well known fact that fires occurring in poorly ventilated spaces, such as basements, theatres, ships, etc., are usually the most destructive ones.

Venting of fires has so far been considered only with large, single-area, single-storey buildings. A few cases are known when it was employed in two-storey structures. No consideration has ever been given to using fire-venting in multi-storey buildings of residential, institutional or business occupancies, for which the operation would, in fact, offer substantial advantages.

If, in a tall building, the flames and hot combustion products are allowed to rise in a heat insulated upwardly extending duct, hereinafter referred to as a "drainage duct", preferably extending throughout the height of the building, the column of hot gases in the drainage duct can create a substantial depression in the space containing the fire. This depression can be utilized in two ways:

1. to draw air to the space containing the fire at a rate above the threshold value, in other words at a rate sufficient to ensure relatively low temperatures and short fire duration, and 2. to produce in the space containing the fire a pressure equal to or lower than that prevailing in any of neighbouring spaces, and thus to retard the flames and smoke from penetrating these spaces.

It follows that with this technique the energy of the fire itself is exploited to render it relatively harmless.

The operaton of the fire drainage system during fire is explained in FIGS. 1, 2 and 3 for three types of building spaces: rooms, uncompartmented spaces and corridors, respectively.

In FIG. 1 there is shown a building space in the form of a typical hotel room in a multi-storey building. Each room 1 has a window 2 part of which is designed to form the "effective opening" 3, and provides the area for the inflow of the bulk of air when fire occurs, as will be explained later. From each room a door 4 leads to a corridor (not shown). A small washroom 5 is attached to the room 1, and a built-in closet 6 is provided for the convenience of the occupant. Upwardly extending duct means, having poor heat transmitting walls, in the form of fire drainage ducts 7 and 8, extend along the entire height of the building and are for connecting the room 1 to the outside atmosphere in the event of fire. In the figure each room 1 is served by two ducts. In turn, each duct, such as 7 or 8, usually serves two adjacent rooms on each floor through closure means in the form of openable access gates 9 and 10 installed near the ceiling of the room 1, and tightly closing and thermally insulating the room 1 from the duct means 7 and 8 respectively. The gates 9 and 10 shown in closed position. The gates 9 and 10 are opened wide on the build-up of fire in the room by means (not shown) urging the access gates 9 and 10 to open and thereby establish connection between the room 1 and the ducts 7 and 8, thus overriding the securing means (not shown) which releasably secure the access gates 9 and 10 in the closed position under normal circumstances. Suitable means urging the access gates 9 and 10 to open, and securing means releasably securing the access gates in the closed position, will be described later with reference to FIG. 6. The drainage ducts 7 and 8 each have, as a rule, access gates 9 and 10 on each floor and may also have release gates (not shown) at the top of each drainage duct 7 and 8 usually above the roof level. These release gates are somewhat different in design from the access gates 9 and 10, and a suitable design will be described with reference to FIG. 6.

In operation in the case of a fire in only one room 1, the access gates in that room 1 and the release gates at the top of the ducts 7 and 8 serving that room 1 will open. The flames and smoke are thus allowed to "drain" from that room 1 to the outside along the drainage ducts 7 and 8 serving that room 1.

A major part of the design process consists of the calculation of the area of "effective openings". For rooms 1, the effective opening 3 is the window area which, after the glass panes are broken by the fire, becomes available for the inflow of air. If the calculations indicate that this area is less than 10 per cent of the floor area of the room 1, it is desirable, for proper lighting, to provide some additional window surfaces made with panes that cannot be dislodged by the fire and are either non-openable, or are self-closing in the event of fire. Based on these considerations, it may be necessary to employ two kinds of glazing: one in the effective opening 3 which breaks very easily under fire exposure, and another in the rest of the window 2, or in the other window openings, which does not break or, at least, remains in place after cracking. According to British Standard Code Practice, CP 153: Part 4: 1972 "Windows and Rooflights, Part 4. Fire Hazards Associated with Glazing in Buildings", ordinary annealed glass qualifies for the first kind. The Standard also describes some glazings that qualify for the second kind.

In general, for heated buildings the design is based on conditions prevailing during the winter heating season when the pressure differences between the various spaces in the building are largest. During this season the pressure in the corridors, below the midheight of the building, is lower than in the room 1. Therefore, to prevent the flames and smoke from penetrating the corridor through gaps around the door 4 or through the door opening, if the door 4 is left open by the escaping tenants, the pressure in the room 1 during the fire must be lowered to a level equal to or below that in the corridor.

To satisfy this condition, in a correct design the effective opening must be selected to fulfill the following requirement:

$$\frac{A_C}{A_D} \leq \frac{1}{1.163\psi\delta}\left\{\frac{1}{2\alpha}\ \frac{\rho_d}{\rho_e}\left[g(\rho_a-\rho_d)\ \frac{H_1-z}{p_e-p}-\frac{p_a-p}{p_e-p}\right]\right\}^{1/2}$$

where, $A_C$ ($m^2$) is the area of effective opening, $A_D$ ($m^2$) is the cross-sectional area of drainage duct, $\psi$ (dimensionless) is a factor characteristic of the air-tightness of the drainage duct (equal to 1 if the duct is completely air-tight, larger than 1 if it is not), $\delta$ (dimensionless) is an orifice factor characteristic of the sizes of the effective opening (usually amounting to about 0.7), $\alpha$ (dimensionless) is a factor describing, in terms of velocity head, the pressure losses at the entry and exit of fire gases to and from the drainage duct (7 and 8), and the frictional pressure losses along the ducts (usually somewhat larger than 1, depends on the design of duct and gates), $g$ ($m/s^2$) is the acceleration due to gravity, $\rho_d$ ($kg/m^3$) is the average density of the fire gases in the drainage duct (7 and 8), $\rho_e$ ($kg/m^3$) is the density of air in the space from which it enters the space (room 1) containing the fire (the density of the outside atmosphere if air enters through broken windows), $\rho_a$ ($kg/m^3$) is the density of the outside atmosphere, $H_1$ (m) is the height of the drainage duct (7 and 8), $z$ (m) is the elevation of the space (room 1) containing the fire, $p_e$ (kg/m $s^2$) is the pressure in the space from which air enters the space (room 1) containing the fire (the pressure of the outside atmosphere if air enters the space (room 1) through broken windows), $p_a$ (kg/m $s^2$) is the pressure of the outside atmosphere, $p$ (kg/m $s^2$) is the desired pressure in the space (room 1) containing the fire, and is selected as equal to or lower than the pressure in any adjoining space which is to be protected from the penetration of flames and fire gases (for example, equal to or lower than the corridor pressure if the space containing the fire is room 1).

The value of the dimensionless factor may be derived from well known handbooks, such as "Fluid Mechanics for Engineers", by P. S. Barna, 3rd Edition, Plenum Press, New York 1969.

The average density of the fire gases in the drainage duct (7 and 8) depends on the fire temperature and, in turn, on the amount of combustible materials in and the flow rate of air into the space (room 1) containing the fire. It can be determined from experiments, or estimated as outlined by the applicant in an article entitled "Fire Drainage: A New Approach to Fire Safety", by T. Z. Harmathy, Internal Report No. 415, July 1974, Division of Building Research, National Research Council of Canada, Ottawa, Canada.

Fulfilling the above requirement is, however, not sufficient. The designer must also ensure that the fire temperature will be relatively low and the fire duration relatively short, in other words, that the fire will be fuel-surface-controlled. According to the state of the art of the time of filing the application, this condition is fulfilled if:

$$C\phi G \leq 0.5$$

where,

C ($kg/m^2$ s) is a constant characteristic of the combustible materials in the space on fire (for mainly cellulosic materials it is approximatey 0.038), $\phi$ ($m^2/kg$) is the specific surface of the combustible materials (for conventional furniture it is usually between 0.12 and 0.18), and G (kg) is the total mass of the combustible materials in the space (room 1) containing the fire.

The formulas given here have been based on the best available knowledge concerning compartment fires. Naturally, it must be understood that this knowledge, as any other knowledge, is subject to changes. The primary purpose of introducing these formulas has been to show the most basic variables involved in the design of the fire drainage system, and to emphasize the importance of the interaction between the drainage duct (7 and 8) and the effective openings in the proper functioning of the system when fire occurs. There are some other variables, which are known to those skilled in the art, that may make it desirable to further modify the design procedure and the formulas. The previously referred Internal Report No. 415, Division of Building Research, National Research Council of Canada, gives a more detailed description of these and other variables which may be involved in the design of the fire drainage system.

In FIG. 2 a large uncompartmented office space is shown. The ceiling area is divided into a large number of rectangular areas by a series of retracted fold-up or roll-up drop curtains 11 each made of light-gauge metal or some heat-resistant, metal reinforced material and equipped with a weightier bottom piece. The purpose of these curtains is two-fold. First, they restrict the spread of flames and smoke during the growth period of fire when the fire drainage system is not yet operative. Secondly, when activated by the fire, or otherwise, the curtains 11 slide down in the grooves 12 in posts 13 to rest on the floor skirting boards 14. In this way, the curtains 11 together with the floor skirting boards 14 surround a space containing a fire, leaving only four openings 15 for the entrance of air. By surrounding a space containing a fire in this manner the curtains 11 and skirting boards 14 not only ensure controlled burning conditions, but also help a fire drainage duct 18 to produce a substantial depression in the space containing a fire in the same manner as the fire drainage ducts 7 and 8 in FIG. 1. A useful purpose of the floor skirting boards 14 is to prevent people from placing furniture or other objects below the fold-up curtains 11 where their presence may interfere with the operation of the curtains.

Obviously, even though the occupants may have an unobstructed view over practically the entire area, the uncompartmented space is, in fact, subdivided into a number of elementary areas 16. Windows 17 are located at the peripheries of the uncompartmented space. The drainage ducts 18 may be located at the center of each elementary area, and can be conveninently combined with building columns 19. The drainage ducts 18 extend along the entire height of the building, and each has four access gates 20 next to the ceiling on every floor.

As with the previous embodiment, the operation involves the withdrawal of the fire and smoke through the gates 20 and drainage ducts 18 and admission of air to the space containing fire through floor skirting board openings 15 in quantities, determined by design, to produce low fire severity and the required depression in the space during fire. This is achieved by satisfying the two requirements given earlier in connection with the embodiment shown in FIG. 1, where in the present embodiment the effective opening $A_C$ is interpreted as the sum of the openings 15 to an elementary area 16.

In a simpler but less effective embodiment of the present invention the items 12, 13, 14 and 15 (FIG. 2) are omitted and the curtains 11 are replaced by ordinary fixed, permanently extended curtain boards. With this embodiment only a lesser depression can be produced in the fire area by the operation of the drainage duct 18 and, therefore, the spread of flames and smoke to the neighbouring areas may not be completely checked.

FIG. 3 shows a section of a corridor, also equipped with a fire drainage system. Fold-up or roll-up drop curtains 21 made of light-gauge metal or metal-reinforced heat-resistant material and equipped with weightier bottom pieces, are again used with a two-fold purpose; to limit the spread of flames and smoke while retracted, and to control the rate of burning and the pressure in the fire space after their activation. To fulfill these functions, the drop curtains 21 slide down in the grooves 22, to a predetermined distance from the floor, leaving areas next to the floor for the inflow of air. The locations of the drop curtains 21 determines the area of each corridor element 23. The corridor communicates through doors, 24, with rooms on both sides. In the figure, each corridor element 23 is served by one drainage duct 25 and each duct communicates with a number of corridor elements located above each other on the various floors, through access gates 26 or 27.

In operation in the case of fire, the access gate 26, in the corridor element 23 containing the fire, opens wide and the drop curtains 21 on either side of that corridor element 23 slide down to confine the fire to that corridor element. Again, the designer must satisfy the two requirements given in connection with the embodiment shown in FIG. 1, where, in the present embodiment the effective opening, $A_C$, is interpreted as the sum of the areas left open below the drop curtains 21.

In a simpler but less effective embodiment the curtain guiding grooves 22 are omitted and the drop curtains 21 are replaced by fixed curtain boards. However, this embodiment provides a lesser depression in the fire area and consequently may not completely check the spread of fire.

FIG. 4*a* shows diagrammatically an eleven storey office building having five rooms 28, an uncompartmented space 29, and a T-shaped corridor 30 on each floor, and four shafts 31 for elevators and staircases. Washrooms normally contain very little combustibles and, therefore, need not be discussed in the design of the fire drainage system.

FIG. 4*b* shows the fire drainage duct system for the building shown in FIG. 4*a*. It consists of six ducts 32 serving the rooms 28, ten ducts 33 serving the uncompartmented spaces 29, and two ducts 34 serving the corridors 30. The ducts 32, 33 and 34 usually extend above the roof level where they can communicate with the outside atmosphere via the release gates.

In order to best utilize the space and to minimize the pressure losses associated with the entry of flames and smoke, the use of narrow (6 to 12 in. wide) drainage ducts and gates is most advantageous for rooms and corridors. For uncompartmented spaces, ducts of roughly square cross-sectional areas are most advantageous which, as previously stated, may be combined with the building columns. In ducts of roughly square cross-section the access gates are preferably located on all four sides of the ducts and their shape may be closer to a square.

FIG. 5 shows a drainage duct, with suitable closure means, which may be used in any of the embodiments shown in FIGS. 1 to 4*a* and 4*b*.

The walls of the drainage duct are provided with sufficient thermal insulation so that the walls have poor heat transmitting properties and thus prevent damage by heat transmission to spaces located on floors above the space containing the fire. In FIG. 5 the thermal insulation consists of a layer of some heat-resistant insulating material 35, for example, sprayed-on asbestos or alumina-silica fibers, securely attached to a lightweight concrete base 36. In other embodiments, double-walled light metal ducts, filled with water between the walls are used.

For obvious reasons, it is desirable for the gates to be opened by the fire itself. The gates shown in FIG. 5 have the desirable feature that their activation does not depend on the availability of electric power at the time of a fire. In FIG. 5 the access and release gates are shown in closed position. The access gate consists of closure means in the form of two separately openable panels 37 and 38, both attached to a gate frame 39 by hinges 40 at the lower edge of the gate frame 39. The outer panel 38 has thick thermal insulation 41 to protect the gate assembly from heat when the drainage duct is filled with hot gases originating from a fire at a lower floor level. Both the inner and outer panels, 37 and 38 respectively, are sealed to the gate frame 39. An outer seal 42 for panel 38 may be made from a moderately heat-resistant material, while an inner seal 43, for the panel 37 can be of any ordinary sealant. The inner panel 37 is locked to the inside rim of the gate frame 39 by J-shaped studs 44 and nuts 45 or other fastening elements, made from a heat destructible material such as a low-melting alloy or combustible material. The J-shaped studs 44 and nuts 45 form securing means, releasably securing the closure means, panels 37 and 38, in the closed position. The nuts 45 are preferably thermally insulated from the inner panel 37 by thick washers 46 of, for example, a plastic material. A spring 47 is compressed between the inner and outer panels 37 and 38 respectively, and forms the means urging the closure means, panels 37 and 38, to open and thereby establish connection between the building space and the duct means or drainage duct. The panels 37 and 38 are connected by a wire cable 48 which will prevent them from separating by more than a predetermined angle. Instead of spring 47, the urging means may consist of a counter-weight or of the weight of the inner panel 37 itself.

In operation, as a fire builds up in the space, the fastening elements 45 melt or burn and cause the spring 47 to swing open the inner panel 37 which, in turn, pulls the outer panel 38 open by the wire cable 48.

The closed access gate 37 can be made inconspicuous by, for example, being covered with wallpaper. It is preferable, however, that the cover to the access gate 37 be brightly coloured or labelled to remind occupants that this area must not be blocked by furniture or any other obstruction.

The hot gases may leave the fire drainage duct through one, two, three or four release gates of identical design. A release gate assembly is shown in FIG. 5, consisting of a frame 49, and a double-walled gate panel 50, attached to the frame 49 by hinges 51 and sealed to the frame 49 by an ordinary sealant 52. The gate panel 50 is locked by a small lever 53 held in the locking position by a U-shaped tongue 54 and by the pulling force of heat destructible line 55 which may be made of a low-melting or combustible material. A small spring 56 urges the tongue 54 from between the gate panel 50 and the lever 53 in a direction for the lever 53 to clear the frame 49. A pull on the line 55 is exerted by, for example, a weight 57 hanging near the bottom of the duct or by a spring anchored to the bottom of the duct. Pulleys, 58, are used to change the direction of the line.

In operation, with the inner panel 37 and outer panel 38 opened by a fire, the flames entering the duct destroy the line 55, releasing the weight 57, so that the spring 56 pulls the tongue 54 from between the gate panel 50 and the lever 53. The gate panel 50 then falls open under its own weight.

It may be added that the use of release gates is not absolutely necessary. The top end of the drainage ducts may be left open if the openings are satisfactorily protected against precipitation and dirt. Nevertheless, this arrangement is not advantageous, since it may effect undesirable heat losses in the winter or heat gains in the summer.

In designing the fire drainage ducts and gates, a desirable consideration is to make the system reusable without repair, excepting the gates directly involved in the fire.

The types of gates discussed so far were devised for activation by the fire itself. Sometimes it may seem desirable to have the gates activated electrically, hydraulically, pneumatically or otherwise by a signal received from a heat or smoke detector, or to activate them at will manually, electrically, hydraulically, pneumatically or otherwise.

Electrical activation of the access gates can be achieved by slightly modifying the gate closing mechanism, as shown in FIG. 6 where parts similar to those shown in FIG. 5 are designated by the same reference numerals and the previous description is relied upon to describe them. The J-shaped stud designated 44 in FIG. 5 is replaced by a straight stud 59 which has a cylindrical head 60 and can slide in a sleeve 61 fastened to the inner panel 37 of the gate. The head 60 of the stud 59 rests on the projection of a lever 62, one end of which is attached by a pivot 63 to the gate frame 39, and other end by a short thin wire cable 64 to the plunger 65 of a solenoid 66. The solenoid 66 is mounted on an arm 67 which is fastened to the outer panel 38 of the gate. Before and after closing the inner panel 37, the lever 62 is held in horizontal position by the pulling force of a small spring 68.

In operation, the gate can be opened by energizing the solenoid 66 to cause the lever 62 to release the stud 59. The solenoid 66 may be energized manually or by, say, a heat or smoke detector.

A device which can provide for the electrical activation of the release gate is shown in FIG. 7 where similar parts to those shown in FIG. 5 are designated by the same reference numerals and the previous description is relied upon to describe them. Two connecting elements, 69 and 70 are inserted in the heat destructible line 55. The elements 69 and 70 are held together by a pin 71. The pin 71 is attached by a thin wire cable 72 to a plunger 73 of a solenoid 74. By energizing the solenoid 74 the pin 71 is removed from between the connecting elements 69 and 70 and the gate panel 50 is opened.

A different device for the electrical activation of the release gate is also shown in FIG. 7 where a short section of the heat destructible line 55 is surrounded by an electric heating wire 75. If current is passed through the heating wire 75 the heat destructible line 55 breaks due to ignition or melting and the gate panel 50 is opened.

In FIGS. 6 and 7 the activation of the gates is caused by a small movement of a solenoid plunger under the effect of electromagnetic forces. In different embodiments of the present invention this small movement is achieved manually, hydraulically, pneumatically or in other way.

Using the devices shown in FIGS. 6 and 7 the gates can be activated either directly by the flames, as described with reference to FIG. 5 or by the energization of the solenoid. The latter mode of activation can be achieved either automatically, by a signal received from a fire detector, or manually. Although it would not offer any advantages, the feature of activation directly by the flames can be eliminated by replacing the heat destructible fastening element in the case of the access gate, and the heat destructible line in the case of the release gate, by a fastening element and a line, respectively, made of heat resisting materials.

I claim:

1. Means for retarding the spread of fire from a building space, having air intake thereto, comprising:

a. upwardly extending duct means having poor heat transmitting walls, for connecting the building space to the outside atmosphere, b. closure means, tightly closing and thermally insulating the building space from the duct means, c. means urging the closure means to open and thereby establish connection between the building space and the duct means, d. securing means, releasably securing the closure means in the closed position, and wherein e. for most effective operation, the following two conditions are satisfied, relying on the state of the art:

$$\frac{A_c}{A_D} \leq \frac{1}{1.163\psi\delta}\left\{\frac{1}{2\alpha}\frac{\rho_u}{\rho_e}\left[g(\rho_u-\rho_d)\frac{H_1-z}{p_e-p}-\frac{p_u-p}{p_e-p}\right]\right\}^{1/2}$$

and $$\frac{A_c\delta[2\rho_c(p_c-p)]^{1/2}}{C\phi G} > 1$$

where $A_C$ ($m^2$) is the cross-sectional area for the air intake to the building space, $A_D$ ($m^2$) is the cross-sectional area of the duct means, $\psi$ (dimensionless) is a factor characteristic of the airtightness of the duct means, $\delta$ (dimensionless) is an orifice factor characteristic of the sizes of the area for air intake, $\alpha$ (dimensionless) is a factor describing, in terms of velocity head, the pressure losses at the entry and exit of fire gases to and from the duct means, and the frictional losses within the duct means when in operation, $g$ ($m/s^2$) is the acceleration due to gravity, $\rho_d$ ($kg/m^3$) is the average density of the fire gases in the duct means when in operation, $\rho_e$ ($kg/m^3$) is the density of air in the space from which it enters the building space when on fire, $\rho_a$ ($kg/m^3$) is the density of the outside atmosphere, $H_1$ (m) is the height of the duct means, $z$ (m) is the elevation of the building space, $p_e$ ($kg/m\ s^2$) is the pressure of the space from which the bulk of air enters the building space, $p_a$ ($kg/m\ s^2$) is the pressure of the outside atmosphere, $p$ ($kg/m\ s^2$) is the desired pressure in the building space which, for correct operation in fire, is equal to or lower than the pressure in any adjoining space to be protected from the penetration of flames and fire gases, C ($kg/m^2\ s$) is a constant characteristic of the combustible materials in the building space, $\phi$ ($m^2/kg$) is the specific surface of the combustible materials, and G (kg) is the total mass of the combustible materials in the building space, whereby f. in the event of fire in the building space the securing means are actuated to release the closure means, so that the means urging the closure means moves the closure means to connect the building space with the duct means acting in conjunction with the air intake to i) drain away flames and smoke from the fire, ii) produce a depression in the building space thereby retarding the spread of fire, and iii) draw sufficient air to the building space to ensure relatively low fire temperature and a relatively short fire duration.

2. Means according to claim 1, wherein the building space is one of a plurality of buildings spaces, one above another at different floor levels, the closure means is one of a plurality of closure means for each building space, and each closure means has a means urging the closure means to open and a securing means.

3. Means according to claim 1, which includes, at least one release gate closing the upper end of the duct means from the outside atmosphere, and release gate opening means for opening the release gate.

4. Means according to claim 1, wherein the securing means is of a heat destructible material to be destroyed by a fire in the building space thereby allowing the closure means to open.

5. Means according to claim 3, wherein the release gate opening means includes a heat destructible member holding the release gate closed and capable of being destroyed by fire in the duct means to allow the release gate to open.

6. Means according to claim 2, which includes at least one release gate closing the upper end of each duct means from the outside atmosphere, and a heat destructible line holding the release gate in the closed position and extending along the interior of the duct means past each closure means, whereby flames entering the duct means from any of the building spaces will destroy the heat destructible line and open the release gate.

7. Means according to claim 1, which includes drop curtains for isolating the building space, except for air access thereto, from adjacent building space in the event of fire in the building space.

* * * * *